US009278525B2

(12) United States Patent
Miyagishi et al.

(10) Patent No.: US 9,278,525 B2
(45) Date of Patent: Mar. 8, 2016

(54) LIQUID EJECTING HEAD AND LIQUID EJECTING APPARATUS

(71) Applicant: SEIKO EPSON CORPORATION, Tokyo (JP)

(72) Inventors: Akira Miyagishi, Matsumoto (JP); Shunya Fukuda, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/730,347

(22) Filed: Jun. 4, 2015

(65) Prior Publication Data

US 2015/0352844 A1 Dec. 10, 2015

(30) Foreign Application Priority Data

Jun. 10, 2014 (JP) ..... 2014-120027

(51) Int. Cl.
*B41J 2/045* (2006.01)
*B41J 2/14* (2006.01)

(52) U.S. Cl.
CPC ..... *B41J 2/14233* (2013.01); *B41J 2/14201* (2013.01)

(58) Field of Classification Search
CPC ..... B41J 2/14201
See application file for complete search history.

(56) References Cited

U.S. PATENT DOCUMENTS

| | | | | |
|---|---|---|---|---|
| 6,270,203 | B1 | 8/2001 | Kitahara et al. | |
| 6,331,052 | B1 | 12/2001 | Murai et al. | |
| 2010/0171396 | A1* | 7/2010 | Lee et al. | 310/367 |
| 2013/0222487 | A1* | 8/2013 | Ozawa et al. | 347/71 |

FOREIGN PATENT DOCUMENTS

| | | | |
|---|---|---|---|
| JP | 06-234218 | A | 8/1994 |
| JP | 11-157076 | A | 6/1999 |
| JP | 2011-073206 | A | 4/2011 |

* cited by examiner

*Primary Examiner* — Geoffrey Mruk
(74) *Attorney, Agent, or Firm* — Workman Nydegger

(57) ABSTRACT

A liquid ejecting head is equipped with a pressure chamber which is filled with ink, a nozzle which is linked to the pressure chamber, a vibration plate which includes an active section where a piezoelectric element is formed where the pressure inside the pressure chamber is varied, and a throttle flow path where at least a portion of which opposes the vibration plate while ink flows in the Y direction along the vibration plate.

14 Claims, 9 Drawing Sheets

LIQUID EJECTING HEAD AND LIQUID EJECTING APPARATUS

CROSS-REFERENCE TO RELATED APPLICATIONS

The present application claims priority to Japanese Patent Application No. 2014-120027 filed on Jun. 10, 2014, which is hereby incorporated by reference in its entirety.

BACKGROUND

1. Technical Field

The present invention relates to a technique for ejecting liquid such as ink.

2. Related Art

Various techniques for ejecting liquid such as ink onto a medium such as printing paper are proposed in the related art. For example, JP-A-2011-073206 and JP-A-11-157076 each discloses a liquid ejecting head which ejects ink inside a pressure chamber from a nozzle by varying the pressure inside the pressure chamber using vibration in a vibration plate where a piezoelectric element is formed. Ink is supplied to the pressure chamber via an ink supply path where the flow path area (cross sectional area) is less than the pressure chamber. The ink supply path is a flow path in a direction (horizontal direction) along the vibration plate and imparts appropriate flow path resistance to the ink. In addition, JP-A-6-234218 discloses a configuration where ink is supplied to a pressure chamber with a through hole in a direction which is perpendicular to a vibration plate as a flow path.

In the techniques in JP-A-2011-073206 and JP-A-11-157076, a piezoelectric element is formed so as not to overlap with the ink supply path in planar view with regard to the vibration plate (viewed from a direction which is perpendicular to the surface of the vibration plate). Accordingly, there is a problem in that it is difficult to sufficiently secure the size of a region where a piezoelectric element is formed within a vibration plate (a region which vibrates with the piezoelectric element). Meanwhile, in the technique in JP-A-6-234218, since a through hole, which is utilized as a flow path through which ink is supplied to a pressure chamber, is formed using a punch (press) method or the like, it is easy for errors to occur at the position and the inner diameter of the through hole. Accordingly, there is a problem in that it is difficult to realize anticipated flow path characteristics (flow path resistance and the like) with high precision.

SUMMARY

An advantage of some aspects of the invention is to realize anticipated flow path characteristics with high precision while sufficiently securing a region which vibrates within a vibration plate.

A liquid ejecting head according to an aspect of the invention includes a pressure chamber which is filled with a liquid, a nozzle which is linked to the pressure chamber, a vibration plate which includes an active section where a piezoelectric element is formed where the pressure inside the pressure chamber is varied, and a throttle flow path where at least a portion of which opposes the active section while liquid flows in a first direction along the vibration plate. In the above configuration, it is possible to sufficiently secure the active section of the vibration plate (thus, the amount of ink ejection is increased) compared to the configurations of JP-A-2011-073206 and JP-A-11-157076 where a piezoelectric element does not oppose an ink supply path (throttle) since there is an active section (piezoelectric element) on the vibration plate in a range which opposes the throttle flow path. In addition, the throttle flow path is formed with high precision compared to the configuration in JP-A-6-234218 (that is, a configuration where the throttle flow path is along a direction which is perpendicular to the vibration plate) where a through hole, which is formed on a substrate using a method such as a punch method, is utilized as a throttle flow path since the throttle flow path is formed such that liquid flows in a first direction along the vibration plate. Accordingly, it is possible to realize anticipated flow path characteristics (for example, flow path resistance) with high precision.

Here, in a configuration where a vibration plate is installed on a pressure chamber substrate where a pressure chamber is formed, it is possible to form a throttle flow path with a projecting section with a shape that protrudes from an inner wall surface of an opening section which is formed on the pressure chamber substrate. However, based on the configuration where the projecting section is formed on the pressure chamber substrate in a case where the vibration plate and the throttle flow path are made to oppose one another, it is possible for damage to be caused to the vibration plate and the pressure chamber substrate due to stress, which is caused by vibration in the active section of the vibration plate, being concentrated at a base end side of the projecting section of the vibration plate and the pressure chamber substrate. When considering the above circumstances, in the liquid ejecting head according to the invention a configuration is particularly preferable where a flow path substrate may be installed which includes a first portion which opposes the vibration plate and a second portion which protrudes from the first portion to the vibration plate side and where a flow path between the second portion and the vibration plate is set as the throttle flow path. In the above configuration, it is advantageous in that it is possible to suppress damage to each component (for example, the vibration plate and the pressure chamber substrate) which is caused by vibration in the vibration plate since the throttle flow path is formed between the second portion, which is formed on the flow path substrate, and the vibration plate.

In accordance with the aspect of the invention, the second portion may be formed integrally with the flow path substrate. In the above aspect, since the second portion is formed integrally with the flow path substrate, it is advantageous in that it is possible to form the second portion at an anticipated position with high precision compared, for example, to a configuration where the second portion, which is formed separately from the flow path substrate, is installed on the flow path substrate. The above effects are particularly remarkable according to a configuration where the second portion may be formed by etching with regard to a silicon substrate.

The liquid ejecting head according to the aspect of the invention may further include a pressure chamber substrate which is installed between the vibration plate and the flow path substrate and is formed with a first space, where the pressure chamber is configured by the first space, which is formed by the pressure chamber substrate, and a second space which corresponds to the first space. In the above aspect, since the pressure chamber is formed with the first space and the second space, it is possible to increase the capacity of the pressure chamber compared to, for example, a configuration where only the first space is utilized as the pressure chamber. In addition, according to a configuration where the dimension of the second space in a second direction which intersects with the first direction may be less than the dimension of the first space in the second direction in planar view with regard to the vibration plate, since a gap between each of the second spaces which are adjacent to one another is enlarged, it is advantageous in that it is difficult for the influence of pressure variation inside the second space to spread to the surrounding nozzles. Here, even in the configuration where the capacity of the pressure chamber is secured by forming the second space, a configuration is preferable where a linking flow path, which links the pressure chamber and the nozzle, may be formed on the flow path substrate.

A liquid ejecting apparatus according to another aspect of the invention includes the liquid ejecting head according to each of the above aspects. A printing apparatus which ejects ink is a preferred example of the liquid ejecting head, but the applications of the liquid ejecting apparatus according to the invention are not limited thereto.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
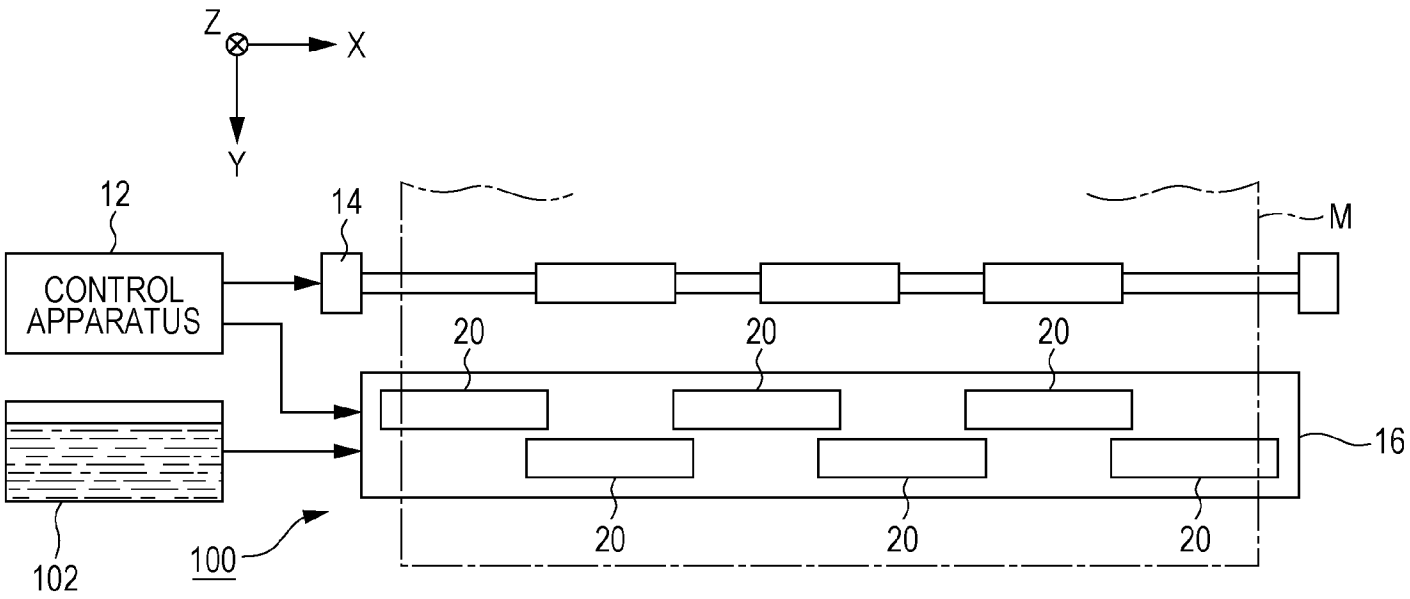
FIG. 1 is a configuration diagram of a printing apparatus according to a first embodiment of the invention.

FIG. 1 is a partial configuration diagram of an ink jet type printing apparatus 100 according to a first embodiment of the invention. The printing apparatus 100 of the first embodiment is a liquid ejecting apparatus which ejects ink, which is an exemplification of a liquid, onto a medium M such as printing paper and is equipped with a control device 12, a transport mechanism 14, and a head module 16. The control device 12 collectively controls each of the components of the printing apparatus 100. The transport mechanism 14 transports the medium M in the Y direction under control by the control device 12. In addition, a cartridge 102, which is filled with ink, is mounted on the printing apparatus 100.

The head module 16 in FIG. 1 is configured to include a plurality of liquid ejecting heads 20. The head module 16 of the first embodiment is a line head where the plurality of liquid ejecting heads 20 are aligned along the X direction which intersects with the Y direction (in a so-called zig-zag arrangement or staggered arrangement). Each of the liquid ejecting heads 20 ejects ink, which is supplied from the cartridge 102, onto the medium M under control by the control device 12. A desired image is formed on the surface of the medium M by each of the liquid ejecting heads 20 ejecting ink onto the medium M in parallel with transport of the medium M by the transport mechanism 14. Here, a direction which is perpendicular to the X-Y horizontal plane (the horizontal plane which is parallel to the surface of the medium M) is represented below by the Z direction. The ejection direction (downward in the vertical direction) of the ink by each of the liquid ejecting heads 20 is equivalent to the Z direction.

Figure 2:
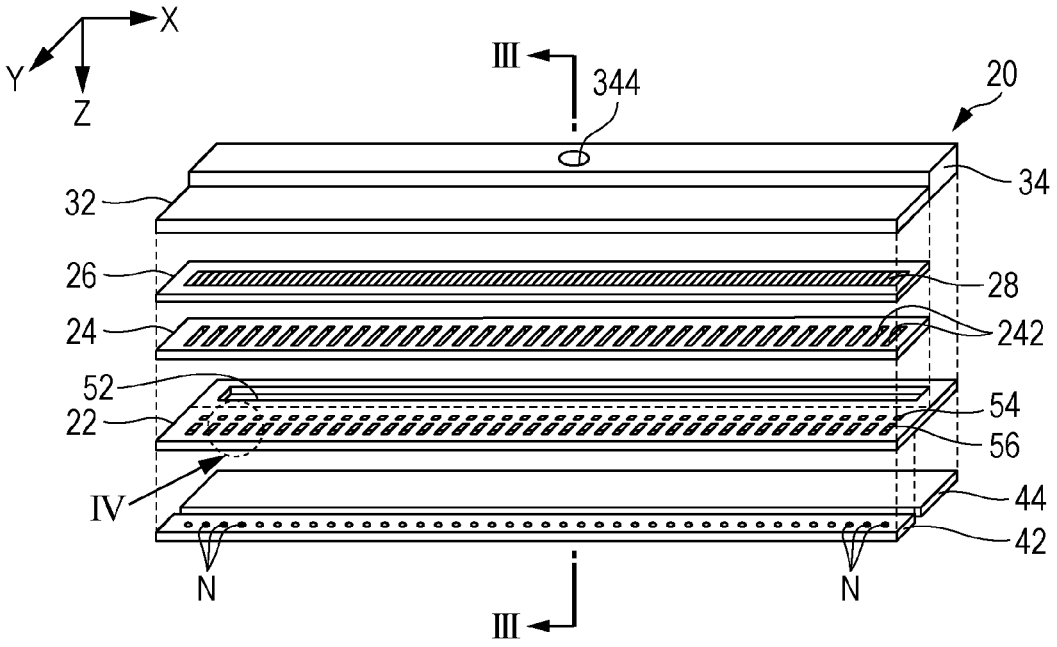
FIG. 2 is an exploded perspective diagram of a liquid ejecting head.
Figure 3:
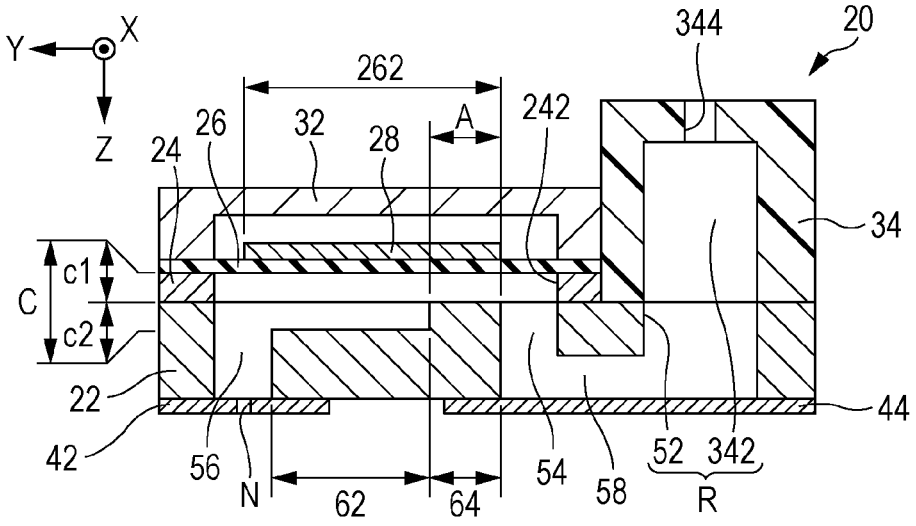
FIG. 3 is a cross sectional diagram of the liquid ejecting head (a cross sectional diagram along line III-III in FIG. 2).

FIG. 2 is an exploded perspective diagram of one arbitrary liquid ejecting head 20, and FIG. 3 is a cross sectional diagram (a horizontal cross section on the Y-Z horizontal plane) along line III-III in FIG. 2. As exemplified in FIG. 2 and FIG. 3, the liquid ejecting head 20 of the first embodiment has a structure where a pressure chamber substrate 24, a vibration plate 26, a protective body 32, and a casing 34 are installed on an upper surface at the negative side in the Z direction within a flow path substrate 22, and a nozzle plate 42 and a compliance section 44 are installed on an upper surface at the positive side in the Z direction within the flow path substrate 22. Each component of the liquid ejecting head 20 is a member with a substantially flat plate shape with a long dimension in the X direction in outline, and are fixed to one another utilizing, for example, a fixing agent.

The nozzle plate 42 is a component with a flat plate shape where a plurality of nozzles (ejection openings) N are formed which are aligned in the X direction, and is fixed to the surface at the positive side in the Z direction within the flow path substrate 22 utilizing, for example, a fixing agent. Each nozzle N has a through hole through which ink passes. The material and the manufacturing method of the nozzle plate 42 are arbitrary, but it is possible to form the nozzle plate 42 with the anticipated shape easily and with high precision by carrying out selective removal on a substrate which is formed, for example, by single crystal silicon (Si) using a semiconductor manufacturing technique such as etching.

Figure 4:
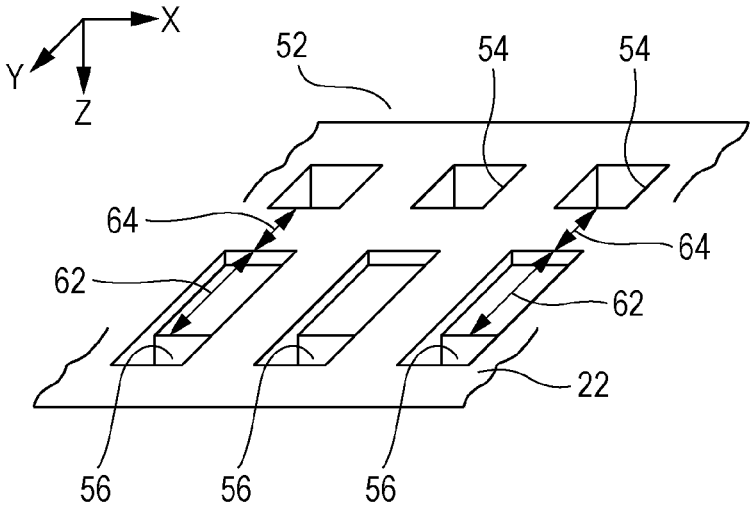
FIG. 4 is a perspective diagram where a flow path substrate is partially enlarged.
Figure 5:
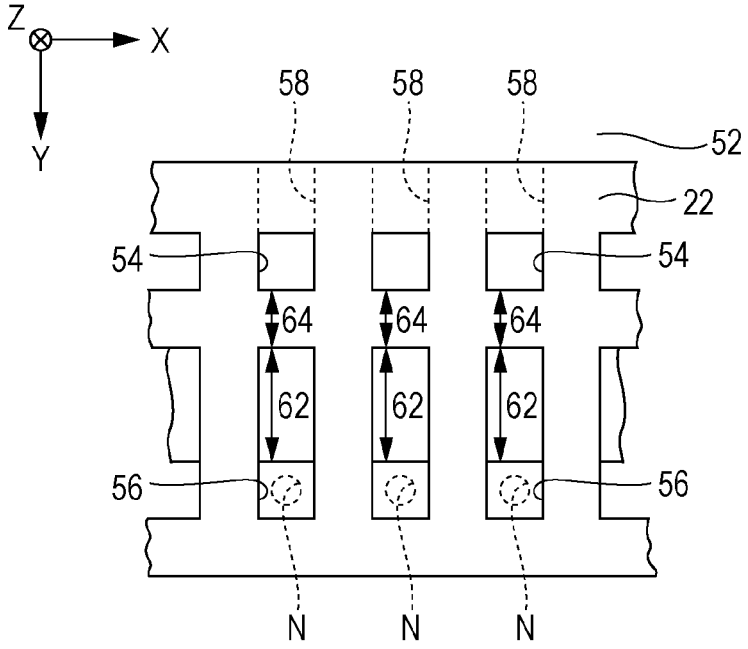
FIG. 5 is a planar diagram where the flow path substrate is partially enlarged.

The flow path substrate 22 is a component with a flat plate shape for forming an ink flow path. FIG. 4 is a perspective diagram where a region IV in FIG. 2 within the flow path substrate 22 is partially enlarged, and FIG. 5 is a planar diagram where the flow path substrate 22 is partially enlarged. As exemplified in FIGS. 3 to 5, an opening section 52, a plurality of supply flow paths 54, and a plurality of linking flow paths 56 are formed on the flow path substrate 22 of the first embodiment. As ascertained from FIG. 2, the opening section 52 is a through hole (opening) with a long dimension in the X direction which is continuous across the plurality of nozzles N. The plurality of supply flow paths 54 are aligned along the X direction in planar view (viewed from the Z direction). In the same manner, the plurality of linking flow paths 56 are aligned along the X direction in planar view. The plurality of supply flow paths 54 are aligned between the opening section 52 and the plurality of linking flow paths 56. Each of the supply flow paths 54 and each of the linking flow paths 56 have a through hole where the nozzle N is formed. As exemplified in FIGS. 3 to 5, a distribution flow path 58 (manifold) with a groove shape, which extends in the Y direction so as to link the supply flow path 54 and the opening section 52, is formed in each supply flow path 54 at the surface at the positive side in the Z direction within the flow path substrate 22. Meanwhile, each of the linking flow paths 56 link one nozzle N.

As exemplified in FIGS. 3 to 5, a first portion 62 and a second portion 64 are formed in a region between the supply flow path 54 and the linking flow path 56 which correspond to one another on the surface at the negative side in the Z direction within the flow path substrate 22. The first portion 62 and the second portion 64 are adjacent to one another in the Y direction in planar view. In detail, the second portion 64 is positioned between the first portion 62 and the supply flow path 54, and the first portion 62 is positioned between the second portion 64 and the linking flow path 56 in planar view with regard to the flow path substrate 22.

As understood from FIG. 3, the first portion 62 is a portion which opposes the vibration plate 26. Meanwhile, the second portion 64 is a projecting section which protrudes from the first portion 62 to the vibration plate 26 side (the negative side in the Z direction). In the first embodiment, a configuration is exemplified where the surface (top surface) of the second portion 64 is positioned in the same surface as the surface of the flow path substrate 22. As understood from FIGS. 3 and 4, the first portion 62 can be said to be a cavity portion (concave section) with regard to the surface of the second portion 64 (the surface of the flow path substrate 22). That is, a space (referred to below as a "second space") c2, where a step between a bottom surface of the first portion 62 and the second portion 64 is high, is formed on an upper surface of the first portion 62.

The flow path substrate 22 of the first embodiment is formed by processing a substrate (referred to below as an "original substrate") which is formed by single crystal silicon (Si). For example, it is possible to form the through hole of the flow path substrate 22 (the opening section 52, each of the supply flow paths 54, and each of the linking flow paths 56) by carrying out partial removal on the original substrate by laser irradiation with regard to the original substrate. In addition, it is possible to form each of the first portions 62 (the cavities with regard to the surface) and each of the distribution flow paths 58 of the flow path substrate 22 by carrying out partial removal on a specific region of the original substrate in the thickness direction using the semiconductor manufacturing technique such as etching. As understood from the above explanation, each of the second portions 64 of the flow path substrate 22 are formed integrally with the flow path substrate 22 by processing the silicon original substrate which utilizes the semiconductor manufacturing technique such as etching. It is possible to form the flow path substrate 22 with the anticipated shape easily and with high precision by utilizing the semiconductor manufacturing technique such as etching as exemplified above. However, the manufacturing method of the flow path substrate 22 is not limited to the above exemplification.

The compliance section 44 in FIG. 3 is a component for suppressing (absorbing) pressure variation within the flow path of the liquid ejecting head 20, and is configured to include, for example, a member with a sheet form which has flexibility. In detail, the compliance section 44 is fixed to the surface at the positive side in the Z direction within the flow path substrate 22 such that the opening section 52, each of the distribution flow paths 58, and each of the supply flow paths 54 of the flow path substrate 22 are blocked. Accordingly, a flow path, which branches from the opening section 52 of the flow path substrate 22 to the distribution flow path 58 of each nozzle N and where ink reaches the supply flow path 54, is formed.

As exemplified in FIG. 3, the casing 34 is fixed to the surface at the negative side in the Z direction within the flow path substrate 22. The material and the manufacturing method of the casing 34 are arbitrary, but, for example, is integrally formed by injection molding of resin material. An accommodating section 342 and an introduction flow path 344 are formed in the casing 34 of the first embodiment. The accommodating section 342 is a concave section (cavity) with an outer shape which corresponds to the opening section 52 of the flow path substrate 22 in planar view, and the introduction flow path 344 is a flow path which links to the accommodating section 342. As understood from FIG. 3, the space, which links the opening section 52 of the flow path substrate 22 and the accommodating section 342 of the casing 34 with one another, functions as a liquid retaining chamber (reservoir) R. Ink is supplied from the cartridge 102, passes through the introduction flow path 344, and is retained in the liquid retaining chamber R. The compliance section 44 in FIG. 3 configures the bottom surface of the liquid retaining chamber R and absorbs pressure variation in ink inside the liquid retaining chamber R.

As exemplified in FIG. 3, the pressure chamber substrate 24 is fixed to the surface at the negative side in the Z direction within the flow path substrate 22. The pressure chamber substrate 24 is fixed to the surface of the flow path substrate 22 utilizing, for example, a fixing agent. As exemplified in FIGS. 2 and 3, a plurality of opening sections 242, which correspond to the different nozzles N, are formed on the pressure chamber substrate 24. The plurality of opening sections 242 are aligned in a straight line form along the X direction.

Figure 6:
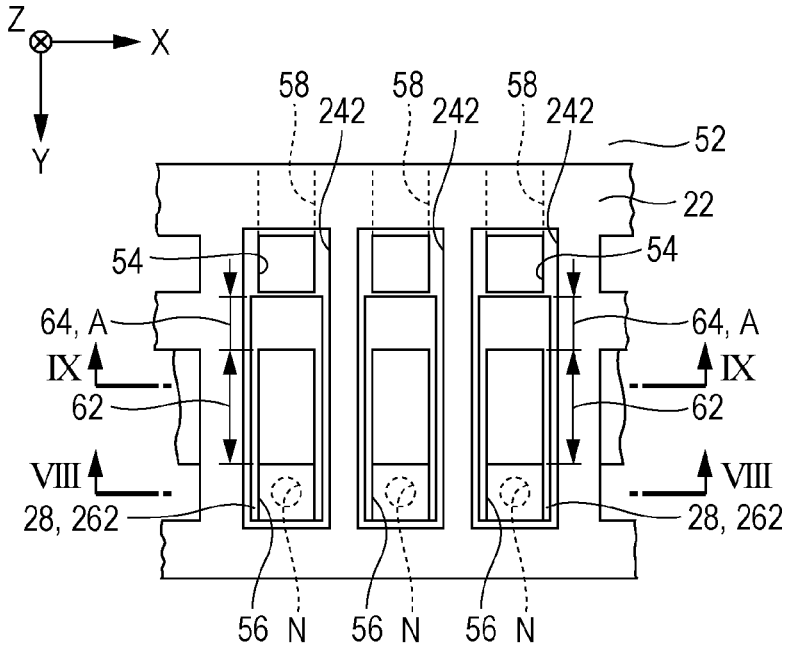
FIG. 6 is a planar diagram illustrating the relationship between each component of the liquid ejecting head.

FIG. 6 is a planar diagram illustrating the relationship between each component of the liquid ejecting head 20. As exemplified in FIG. 6, the opening section 242 which is formed on the pressure chamber substrate 24 is a through hole with a long dimension in the Y direction in planar view. In detail, an end section at the negative side in the Y direction within the opening section 242 overlaps with one supply flow path 54 of the flow path substrate 22 in planar view, and an end section at the positive side in the Y direction within the opening section 242 overlaps with one linking flow path 56 of the flow path substrate 22 in planar view. The material and the manufacturing method of the pressure chamber substrate 24 are arbitrary, but it is possible to form the pressure chamber substrate 24 with the anticipated shape easily and with high precision by carrying out selective removal on a substrate which is formed by single crystal silicon using a semiconductor manufacturing technique in the same manner, for example, to the nozzle plate 42 and the flow path substrate 22 described above.

As exemplified in FIG. 3, the vibration plate 26 is fixed to the surface on the opposite side to the flow path substrate 22 within the pressure chamber substrate 24. The vibration plate 26 is a member with a flat plate form which is able to vibrate elastically. The vibration plate 26 is configured by, for example, a lamination layer between an elastic film which is formed from an elastic material such as silicon oxide, and an insulation film which is formed from an insulation material such as zirconium oxide.

As understood from FIG. 3, the vibration plate 26 and the flow path substrate 22 are opposed so as to open a gap between one another at the inner side of the opening section 242 which is formed on the pressure chamber substrate 24. The space which is positioned between the second portion 64 of the flow path substrate 22 and the vibration plate 26 at the inner side of opening section 242 of the pressure chamber substrate 24 functions as a flow path (referred to below as a "throttle flow path") A which extends in the Y direction parallel to the vibration plate 26. That is, the throttle flow path A is a flow path which causes ink to flow in the direction (the Y direction) along the vibration plate 26. As understood from the above explanation, in the first embodiment the throttle flow path A is formed by the second portion 64 of the flow path substrate 22. In addition, the space, which is positioned between the first portion 62 of the flow path substrate 22 and the vibration plate 26 at the inner side of opening section 242 of the pressure chamber substrate 24, functions as a pressure chamber (cavity) C where pressure is imparted to ink inside the space. That is, in other words the first portion 62 is a component (bottom section) which configures a bottom surface of the pressure chamber C. The pressure chamber C is formed individually in each nozzle N.

As understood from FIG. 3, the pressure chamber C of the first embodiment is configured to include a first space c1 which is positioned at the downstream side of the throttle flow path A at the inner side of the opening section 242 of the pressure chamber substrate 24 and a second space c2 which is formed on the upper surface of the first portion 62 of the flow path substrate 22. As shown in the exemplification above, according to the configuration where the pressure chamber C includes the first space c1 and the second space c2, it is possible for the capacity of the pressure chamber C to be increased (thus, the amount of ink ejection is increased) compared to, for example, a configuration (referred to below as "comparative example") where only the first space c1 forms the pressure chamber C. In addition, it is advantageous in that it is easy to secure mechanical strength (rigidity) of the pressure chamber substrate 24 by utilizing the second space c2 as the pressure chamber C additionally to the first space c1 since the area of the opening section 242 for securing the anticipated capacity of the pressure chamber C is reduced compared to the comparative example.

As understood from FIG. 3, each of the linking flow paths 56 of the flow path substrate 22 link the pressure chamber C and the nozzle N with one another. In addition, the throttle flow path A of the first embodiment is formed in each pressure chamber C (each nozzle N) and is positioned at the upstream side of the pressure chamber C. As understood from FIG. 3, the throttle flow path A is a flow path where the flow path area is small (that is, is throttled) compared to the supply flow path 54 at the upstream side and the pressure chamber C at the downstream side.

As understood from the above explanation, after being retained in the liquid retaining chamber R and being branched to the plurality of distribution flow paths 58, ink is passed through the supply flow path 54 and the throttle flow path A and is supplied and filled into each of the pressure chambers C in parallel, and according to vibration of the vibration plate 26, is passed through the linking flow path 56 and the nozzle N and ejected from the pressure chamber C to the outside. The throttle flow path A of the first embodiment is a resistance flow path for imparting appropriate flow path resistance to the ink between the liquid retaining chamber R and the pressure chamber C.

A plurality of piezoelectric elements 28 which correspond to different nozzles N (pressure chambers C) are formed on the surface which is opposite to the pressure chamber substrate 24 within the vibration plate 26. Each of the piezoelectric elements 28 vibrate individually due to the supply of a driving signal. The protective body 32 is a component which reinforces the mechanical strength of the pressure chamber substrate 24 and the vibration plate 26 while securing each of the piezoelectric elements 28, and is fixed to the surface of the pressure chamber substrate 24 (the vibration plate 26) using, for example, a fixing agent. Each of the piezoelectric elements 28 are accommodated in a concave section which is formed on the surface at the vibration plate 26 side within the protective body 32.

Figure 7:
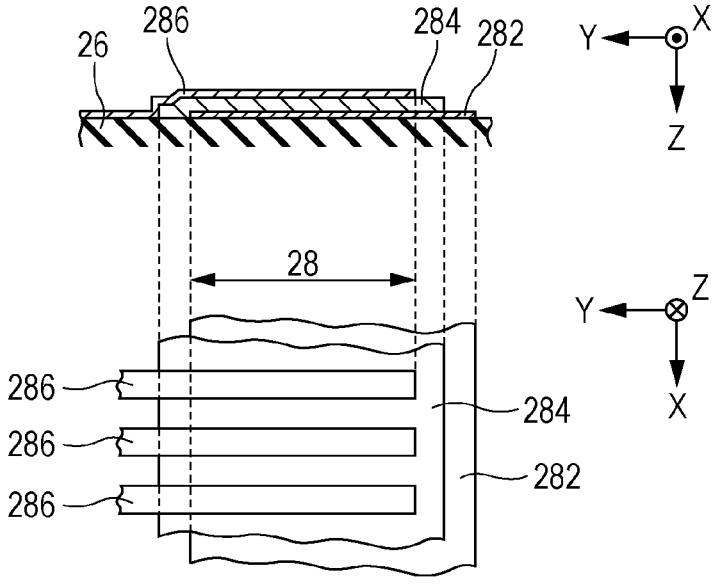
FIG. 7 is a cross sectional diagram and a planar diagram of a piezoelectric element.

FIG. 7 is an enlarged planar diagram and a cross sectional diagram of the piezoelectric element 28. As exemplified in FIG. 7, a first electrode 282, a piezoelectric body 284, and a plurality of second electrodes 286 are formed on the surface of the vibration plate 26. The first electrode 282 is formed on the surface of the vibration plate 26 so as to be continuous across the plurality of piezoelectric elements 28. The piezoelectric body 284 is formed on the surface of the first electrode 282. The second electrodes 286 are formed individually on each of the piezoelectric elements 28 (each of the nozzles N) on the surface of the piezoelectric body 284. Each of the second electrodes 286 are electrodes which extend along the Y direction. A portion where the first electrode 282 and the second electrodes 286 are opposed to each other interposing the piezoelectric body 284 functions as the piezoelectric element 28. Here, it is possible to also adopt a configuration where the second electrodes 286 are individually formed on each of the piezoelectric elements 28 while the first electrode 282 is continuous across the plurality of piezoelectric elements 28.

As understood from FIG. 3, a region (referred to below as an "active section") 262 where the piezoelectric element 28 is formed within the vibration plate 26 varies the pressure inside the pressure chamber C by vibrating with the piezoelectric element 28. In other words, the active section 262 on the vibration plate 26 is a region which overlaps with the piezoelectric element 28 (a region where the pressure from the piezoelectric element 28 directly acts) in planar view. As understood from FIGS. 3 and 6, the throttle flow path A and the vibration plate 26 (the active section 262) oppose one another (that is, directly face one another). In detail, the second portion 64 where the throttle flow path A is formed and the active section 262 of the vibration plate 26 overlaps with one another in planar view. As understood from the above explanation, in the first embodiment the active section 262 of the vibration plate 26 extends in the Y direction over one or both of the pressure chamber C and the throttle flow path A in planar view.

Figure 8:
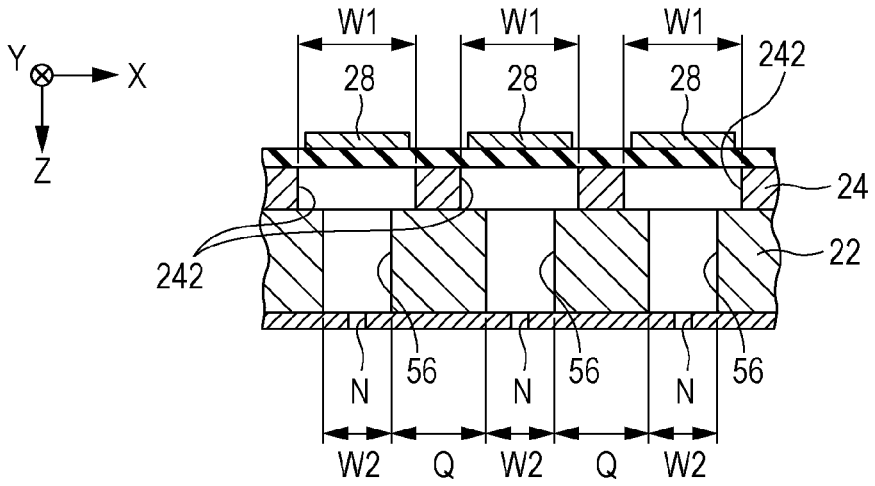
FIG. 8 is a cross sectional diagram along line VIII-VIII in FIG. 6.
Figure 9:
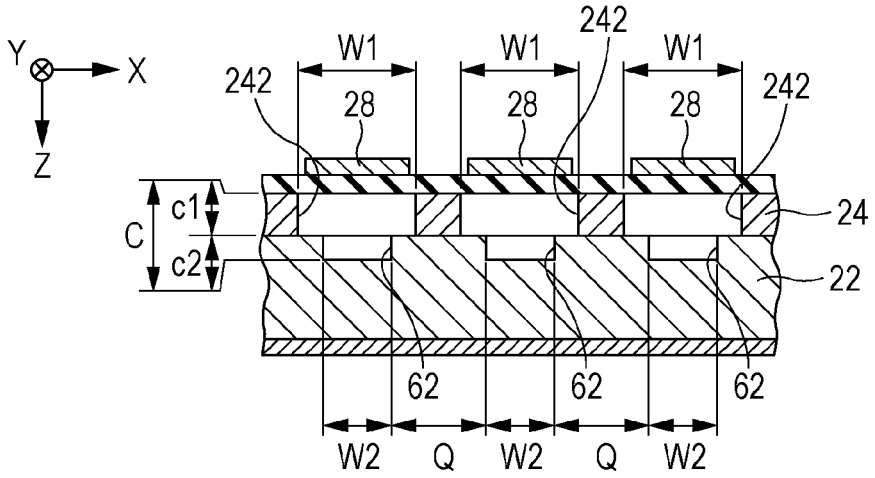
FIG. 9 is a cross sectional diagram along line IX-IX in FIG. 6.

FIG. 8 is a cross sectional diagram along line VIII-VIII in FIG. 6, and FIG. 9 is a cross sectional diagram along line IX-IX in FIG. 6. As understood from FIG. 9, when focusing on the first space c1 and the second space c2 which configure the pressure chamber C, a dimension (the width of the first portion 62) W2 of the second space c2 in the X direction is less than a dimension (the width of the opening section 242) W1 of the first space c1 in the X direction. In the same manner, as understood from FIG. 8, the dimension W2 of the linking flow path 56 in the X direction is less than the dimension W1 of the first space c1 in the X direction. In the above configuration, the second spaces c2 between each of the nozzles which are adjacent to one another in the X direction and gaps Q between the linking flow paths 56 are enlarged compared to a configuration where the second space c2 and the dimension W2 of the linking flow path 56 are secured in a similar manner to the dimension W1 of the first space c1. Accordingly, according to the first embodiment, it is advantageous in that it is difficult for the influence of pressure variation inside the second space c2 or inside the linking flow path 56 to spread to the surrounding nozzles N.

As understood from the above explanation, in the first embodiment, the active section 262 of the vibration plate 26 is formed not only in a range which opposes the pressure chamber C but also in a range which opposes the throttle flow path A in planar view. That is, the area of the active section 262 of the vibration plate 26 is expanded compared to the techniques in JP-A-2011-073206 and JP-A-11-157076 where the piezoelectric element 28 is formed in the ink supply path where the flow path area is less than the pressure chamber C so as not to overlap with the ink supply path in planar view. Accordingly, it is possible to increase the amount of ink ejection compared to the techniques in JP-A-2011-073206 and JP-A-11-157076. In addition, in the first embodiment, it is easy to form the throttle flow path A with the anticipated shape with high precision compared to the configuration in JP-A-6-234218 (that is, a configuration where the throttle flow path A is along the Z direction) where the through hole, which is formed on the substrate using a method such as a punch method, is utilized as the throttle flow path since the throttle flow path A is formed in the Y direction along the vibration plate 26. Accordingly, it is advantageous in that it is possible to realize anticipated flow path characteristics (for example, flow path resistance) with high precision. In particular, in the first embodiment, the effects described above are particularly remarkable in that it is possible to form the throttle flow path A with the anticipated shape with high precision since the second portion 64 which configures the throttle flow path A is formed by etching with regard to the silicon original substrate. In addition, according to the first embodiment, it is possible to realize anticipated ejection characteristics with high precision since the flow path characteristics such as flow path resistance influence ejection characteristics such as the amount of ink ejection.

Figure 10:
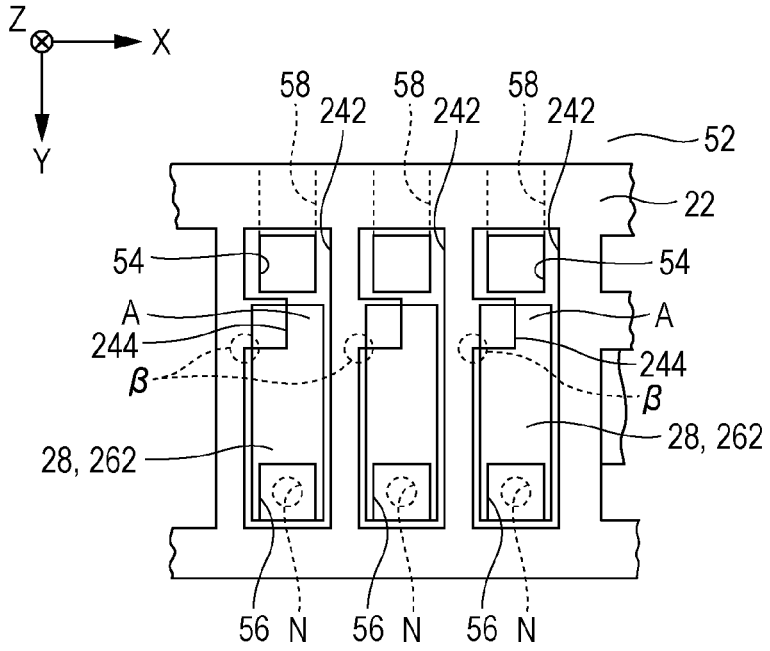
FIG. 10 is a planar diagram of a modified example of the first embodiment.

Here, as a configuration where the throttle flow path A is formed along the vibration plate 26, as exemplified in FIG. 10, for example, it is possible to also adopt a configuration where the projecting section 244, which protrudes from the inner wall surface of the opening section 242 of the pressure chamber substrate 24 in the X direction, is formed. A location where the width is constricted at the projecting section 244 within the opening section 242 functions as the throttle flow path A. However, in a case where the active section 262 of the vibration plate 26 is formed so as to oppose the throttle flow path A in planar view in the configuration in FIG. 10, damage (cracks) may be caused to be generated in the vibration plate 26 or the pressure chamber substrate 24 due to stress, which is caused by vibration in the active section 262, being concentrated at a corner section (a location where the shape abruptly changes such as region β in FIG. 10) where the projecting section 244 protrudes from the inner wall surface of the opening section 242. In the first embodiment, it is advantageous in that it is possible to prevent damage to the vibration plate 26 and the pressure chamber substrate 24 since the throttle flow path A is formed at the second portion 64 which is formed in the flow path substrate 22 which opposes the vibration plate 26 so as to open a gap (that is, does not directly contact the vibration plate 26). However, it is possible that the configuration in FIG. 10 where the projecting section 244 is formed in the pressure chamber substrate 24 is also contained in the range of the invention.

Second Embodiment

The second embodiment of the invention will be described below. Here, in each of the aspects exemplified below, concerning components which have the same actions and functions as the first embodiment, detailed explanation will be omitted as appropriate by using the same reference numerals which are explained in the first embodiment.

Figure 11:
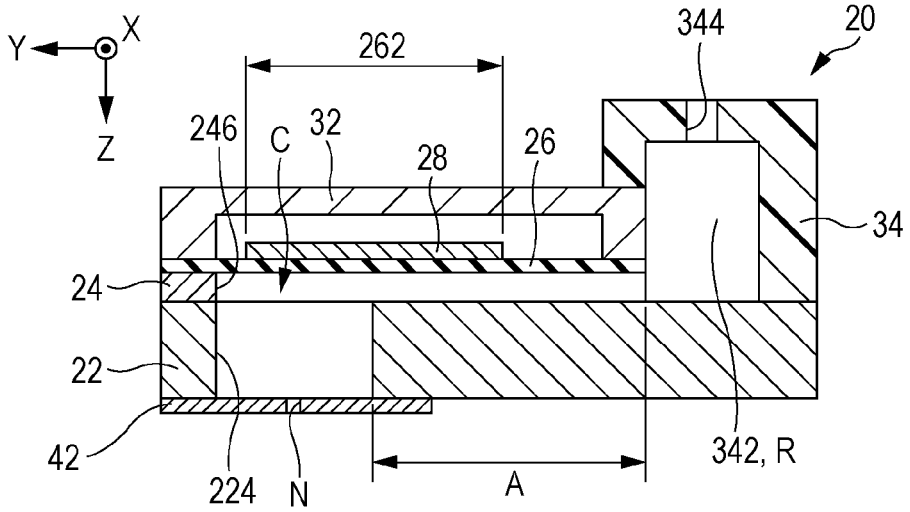
FIG. 11 is a cross sectional diagram of a liquid ejecting head according to a second embodiment of the invention.
Figure 12:
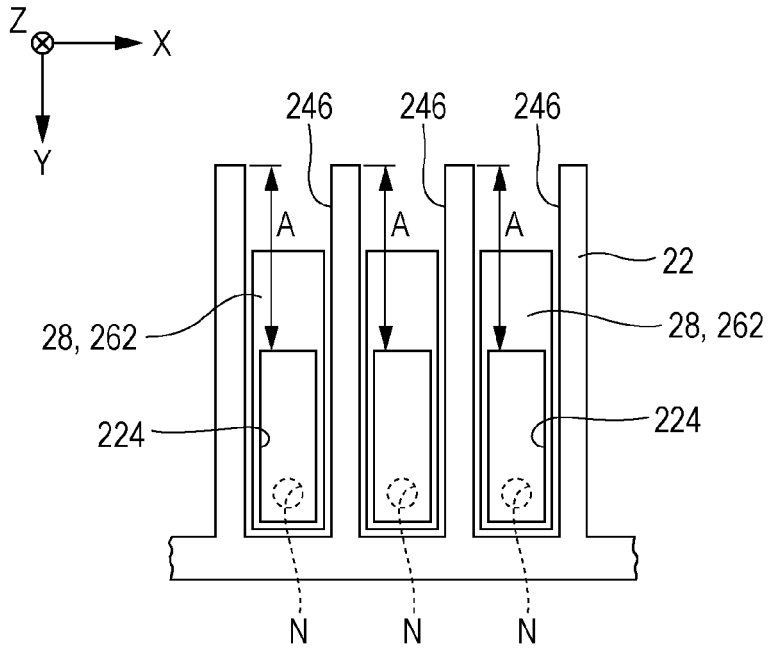
FIG. 12 is a planar diagram illustrating the relationship between each component of the liquid ejecting head of the second embodiment.

FIG. 11 is a cross sectional diagram of the liquid ejecting head 20 in the second embodiment of the invention, and FIG. 12 is a planar diagram illustrating the relationship between each component of the liquid ejecting head 20 of the second embodiment (a planar diagram which corresponds to FIG. 6 mentioned above). As exemplified in FIGS. 11 and 12, an opening section 246, which extends in the Y direction so as to reach to a side surface which is positioned at the negative side (the liquid retaining chamber R side) in the Y direction, is formed in each of the nozzles N on the pressure chamber substrate 24 of the second embodiment. As understood from FIG. 11, each of the opening sections 246 of the pressure chamber substrate 24 are directly linked to the liquid retaining chamber R.

As exemplified in FIGS. 11 and 12, an opening section 224 is formed in each of the nozzles N on the flow path substrate 22 of the second embodiment. The opening section 224 is a through hole in which the pressure chamber C is formed along with the opening section 246 of the pressure chamber substrate 24 and is linked to each of the nozzles N which are formed on the nozzle plate 42. The space, which is interposed between the surface of the flow path substrate 22 and the vibration plate 26 at the inner side of one arbitrary opening section 242 of the pressure chamber substrate 24, functions as the throttle flow path A. As understood from the above explanation, in the same manner as the first embodiment, the throttle flow path A of the second embodiment causes ink to flow in the Y direction along the vibration plate 26.

As exemplified in FIGS. 11 and 12, the active section 262 of the vibration plate 26 (the piezoelectric element 28) extends in the Y direction along both the pressure chamber C (the opening section 224) and the throttle flow path A in planar view. That is, in the second embodiment, in the same manner as in the first embodiment, a portion of the throttle flow path A along the vibration plate 26 opposes the vibration plate 26. Accordingly, similar effects to those in the first embodiment are also realized in the second embodiment.

Third Embodiment

Figure 13:
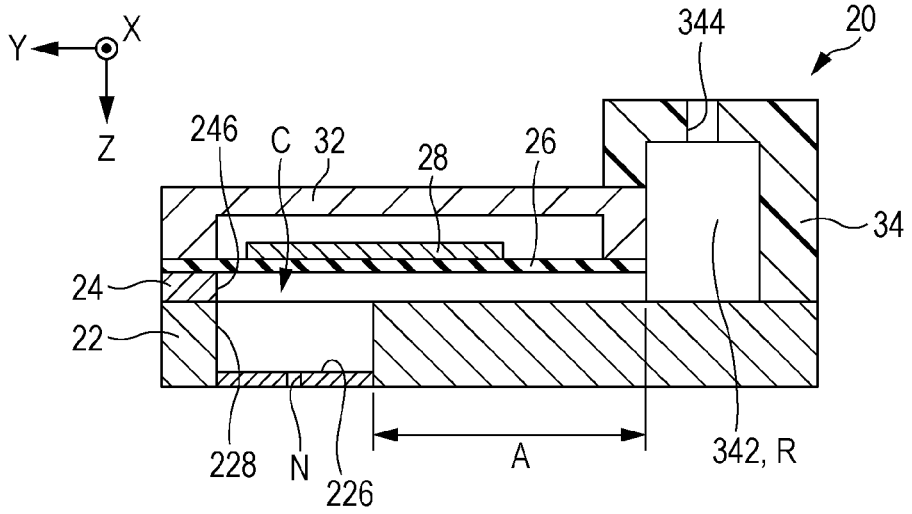
FIG. 13 is a cross sectional diagram of a liquid ejecting head according to a third embodiment of the invention.

FIG. 13 is a cross sectional diagram of the liquid ejecting head 20 according to the third embodiment of the invention. In the second embodiment (FIG. 11), the nozzle plate 42, where the plurality of nozzles N are formed, is installed on the flow path substrate 22. In the liquid ejecting head 20 of the third embodiment, as exemplified in FIG. 13, the plurality of nozzles N are formed on the flow path substrate 22. In detail, instead of the opening section 224 which is exemplified in FIG. 11, an opening (a bottomed hole) section 228, where a bottom section 226 is positioned at the positive side in the Z direction, is formed in each of the piezoelectric elements 28 on the flow path substrate 22, and the nozzle N is formed in the bottom section 226 of each of the opening sections 228. The nozzle plate 42 of the first embodiment and the second embodiment is omitted from the third embodiment.

Similar effects to those in the second embodiment are also realized in the third embodiment. In addition, in the third embodiment, since the plurality of nozzles N are formed on the flow path substrate 22, it is advantageous in that the configuration is simplified (for example, the number of components is reduced) compared to the first embodiment and the second embodiment where the nozzle plate 42 is installed separately to the flow path substrate 22. Here, in the above explanation, a perspective is explained where the plurality of nozzles N are formed on the flow path substrate 22, but it is also possible to conceive that the flow path substrate 22 of the third embodiment may be a nozzle plate where the opening section 228 is formed in each of the nozzles N.

Modified Examples

It is possible for the aspects which are exemplified above to be variously modified. Modified aspects will be exemplified in detail below. It is possible to appropriately combine two or more aspects which are arbitrarily selected from the following exemplifications within a range which is not mutually inconsistent.

(1) In each of the aspects described above, the second portion 64 is formed integrally with the flow path substrate 22 by etching with regard to the original substrate which is formed from silicon, but it is also possible to install the second portion 64, which is formed separately from the flow path substrate 22, on the flow path substrate 22. For example, it is possible to adopt a configuration where a substrate (a substrate which is separate from the flow path substrate 22), which includes the second portion 64 with a form similar to the exemplifications of each of the aspects described above, is laminated on the flow path substrate 22. However, in the configuration where the second portion 64 is formed separately from the flow path substrate 22, there is a possibility that errors may occur in the flow path characteristics (for example, flow path resistance) of the throttle flow path A caused by errors in the position where the second portion 64 is installed. Meanwhile, according to each of the aspects described above where the second portion 64 is formed by etching with regard to the original substrate, the second portion 64 is formed at the anticipated position with high precision. Accordingly, from the perspective of realizing anticipated flow path characteristics with high precision, a configuration where the second portion 64 is formed integrally with the flow path substrate 22 as shown in each of the aspects described above is preferable.

Figure 14:
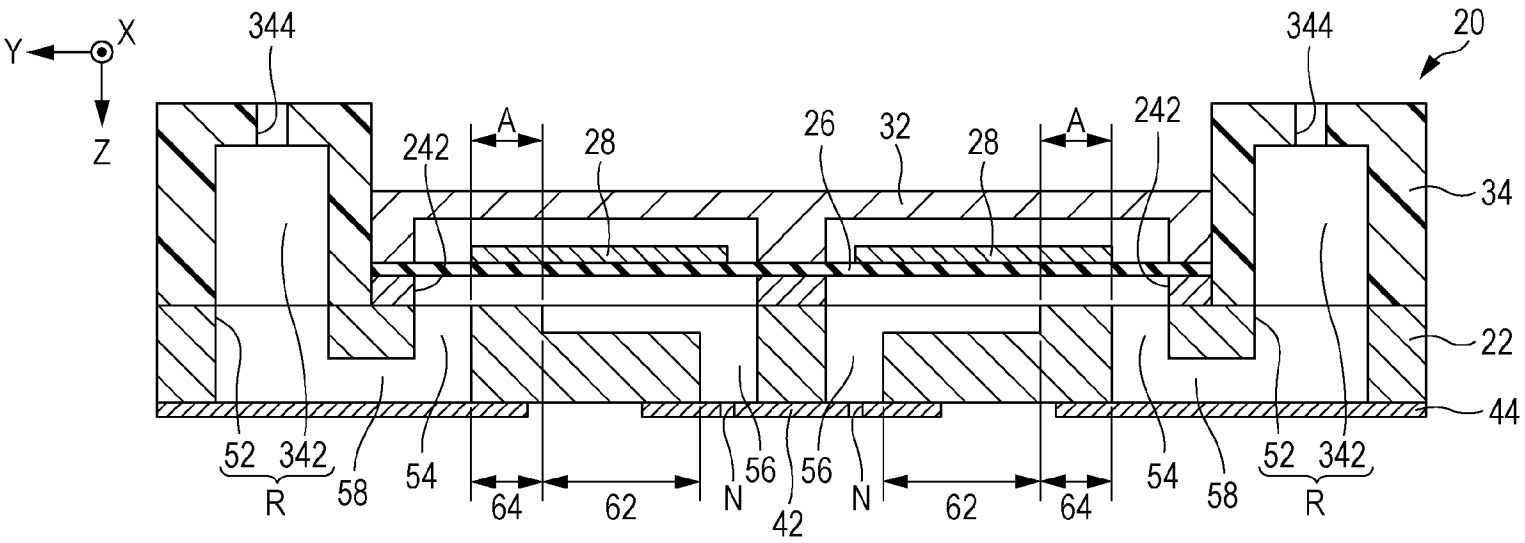
FIG. 14 is a cross sectional diagram of a liquid ejecting head according to a modified example.

(2) In each of the aspects described above, a configuration is exemplified where the plurality of nozzles N are aligned in one row, but as exemplified in FIG. 14, it is also possible to realize the liquid ejecting head 20 where ink is ejected from two rows of the nozzles N by arranging the configuration substantially line symmetrically in the same manner as each of the aspects described above.

Figure 15:
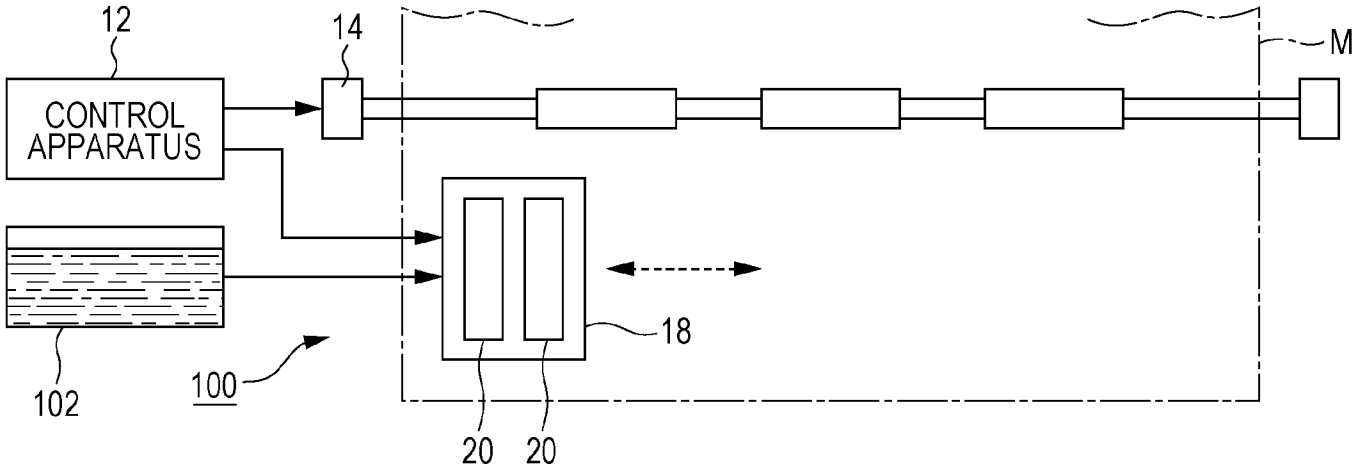
FIG. 15 is a configuration diagram of a printing apparatus according to a modified example.

(3) In each of the aspects described above, a line head is exemplified where the plurality of liquid ejecting heads 20 are aligned in the X direction which is orthogonal to the Y direction in which the medium M is transported, but it is possible to also apply the invention to a serial head. For example, as exemplified in FIG. 15, each of the liquid ejecting heads 20 eject ink onto the medium M while a carriage 18, on which the plurality of liquid ejecting heads 20 according to each of the aspects described above are mounted, moves back and forth in the X direction under control by the control device 12.

(4) It is possible to adopt the printing apparatus 100 which is exemplified in each of the aspects above in various devices such as a facsimile apparatus or a copy machine as well as a device which is specialized for printing. However, the applications of the liquid ejecting apparatus of the invention are not limited to printing. For example, a liquid ejecting apparatus which ejects color liquid is utilized as a manufacturing apparatus which forms a color filter of a liquid crystal display apparatus. In addition, a liquid ejecting apparatus which ejects a conductive material solution is utilized as a manufacturing apparatus which forms an electrode and a wiring of a wiring substrate.

What is claimed is:

1. A liquid ejecting head comprising:

a pressure chamber which is filled with a liquid;

a nozzle which is linked to the pressure chamber;

a vibration plate which includes an active section where a piezoelectric element is formed where the pressure inside the pressure chamber is varied; and a throttle flow path where at least a portion of which opposes the active section while liquid flows in a first direction along the vibration plate.

2. The liquid ejecting head according to claim 1, further comprising:

a flow path substrate which includes a first portion which opposes the vibration plate and a second portion which protrudes from the first portion to the vibration plate side, wherein the throttle flow path is a flow path between the second portion and the vibration plate.

3. The liquid ejecting head according to claim 2, wherein the second portion is formed integrally with the flow path substrate.

4. The liquid ejecting head according to claim 3, wherein the second portion is formed by etching with regard to a silicon substrate.

5. A liquid ejecting apparatus comprising the liquid ejecting head according to claim 4.

6. A liquid ejecting apparatus comprising the liquid ejecting head according to claim 3.

7. The liquid ejecting head according to claim 2, further comprising:

a pressure chamber substrate which is installed between the vibration plate and the flow path substrate and is formed with a first space, wherein the pressure chamber is configured by the first space, which is formed by the pressure chamber substrate, and a second space which corresponds to the first space.

8. The liquid ejecting head according to claim 7, wherein the dimension of the second space in a second direction which intersects with the first direction is less than the dimension of the first space in the second direction in planar view with regard to the vibration plate.

9. A liquid ejecting apparatus comprising the liquid ejecting head according to claim 8.

10. A liquid ejecting apparatus comprising the liquid ejecting head according to claim 7.

11. The liquid ejecting head according to claim 2, wherein a linking flow path, which links the pressure chamber and the nozzle, is formed on the flow path substrate.

12. A liquid ejecting apparatus comprising the liquid ejecting head according to claim 11.

13. A liquid ejecting apparatus comprising the liquid ejecting head according to claim 2.

14. A liquid ejecting apparatus comprising the liquid ejecting head according to claim 1.

* * * * *